US005282546A

United States Patent [19]

Bauer

[11] Patent Number: 5,282,546

[45] Date of Patent: Feb. 1, 1994

[54] COMPOSITE ABOVE GROUND LIQUID STORAGE VAULT

[75] Inventor: Darleen K. Bauer, Severna Park, Md.

[73] Assignee: Hoover Group, Inc., Alpharetta, Ga.

[21] Appl. No.: 91,682

[22] Filed: Jul. 15, 1993

[51] Int. Cl.[5] ..... B65D 90/06

[52] U.S. Cl. ..... 220/565; 220/445; 220/453; 220/464; 220/468

[58] Field of Search ..... 220/565, 445, 446, 453, 220/464, 468

[56] References Cited

U.S. PATENT DOCUMENTS

| | | | |
|---|---|---|---|
| 4,374,478 | 2/1983 | Secord et al. | 220/565 |
| 4,584,802 | 4/1986 | Casselman et al. | 220/565 |
| 4,934,122 | 6/1990 | Linquist . | |
| 4,986,436 | 1/1991 | Bambaciano et al. | 220/565 |
| 4,989,447 | 2/1991 | Gelin | 220/565 |
| 5,000,342 | 3/1991 | Sharp | 220/455 |
| 5,103,996 | 4/1992 | McGarvey | 220/565 |
| 5,174,079 | 12/1992 | Bambacigno . | |

*Primary Examiner*—Joseph Man-Fu Moy
*Attorney, Agent, or Firm*—Harness, Dickey & Pierce

[57] ABSTRACT

A composite above ground liquid storage vault. The vault includes an inner tank defining a containment cavity for the liquid. The inner tank is enclosed within an insulating layer and a monitor tube is positioned adjacent to the insulating layer so as to extend to a location exterior of the vault. A liquid impervious membrane encapsulates the monitor tube, the insulating layer and the inner tank. The encapsulated inner tank is positioned within an outer tank and spaced apart from the interior surfaces of the outer tank by spacers supporting the encapsulated inner tank. A structural and insulating material is located within this space so as to completely surround the inner tank and form a fire wall.

20 Claims, 4 Drawing Sheets

COMPOSITE ABOVE GROUND LIQUID STORAGE VAULT

BACKGROUND AND SUMMARY OF THE INVENTION

The invention relates to above ground liquid storage containers and, more specifically, to a composite above ground liquid storage container, also known as a vault, which incorporates features that enable the detection of fluid leaking from the primary containment cavity of the vault.

The interest in the safe containment of hazardous liquids, particularly volatile fuels such as gasoline, is a continuous one. Previously, these liquids were stored in large capacity underground tanks. The various reasons for using underground or buried tanks have included eliminating the possibility that the tank would be ruptured by a vehicle during an accident; reducing the inherent fire risks associated with volatile liquid storage by insulating the storage vessel from an external heat source or fire; and neutralizing leaked liquid by having it absorbed into the surrounding soil thereby reducing the risk of a contaminated ground surface, a potential fire and various other health and safety risks.

It has become increasingly apparent that the risks associated with leaking underground storage tanks can, and often do, outweigh the benefits of underground storage and can outweigh the risks associated with above ground storage. Underground storage tank leaks have been found to have serious short term and long term environmental consequences. The widespread use of underground storage and the known and potential liabilities have lead to the inspection, removal and replacement of numerous leaking storage tanks. With the cost of inspecting, removing and replacing the underground tank being quite high in and of itself, the expense escalates if it is found that the surrounding soil has been contaminated and requires environmental reclamation.

Once a leaking tank has be identified and the associated cleanup has been completed, businesses are now considering the various alternatives to burying another tank. One alternative is the above ground storage vault.

Above ground storage tanks must meet stringent Environmental Protection Agency (EPA) regulations. These regulations vary widely and depend on the particular liquid being stored. Additionally, again depending on the specific liquid to be contained within the vault, the regulations promulgated by the National Fire Protection Association and the Uniform Fire Code must also be met. While the regulations vary from liquid to liquid, some common safety requirements include, but are not limited to, insulation from extreme external heat sources and resistance to natural and man-made physical disasters such as earthquakes and vehicle accidents.

A variety of storage tank which has been used both above and below ground is the double walled or dual containment tank. Typically, dual containment tanks include an inner tank for primary liquid containment and an outer tank providing secondary containment. A space is generally provided between the inner and outer tanks and is used to monitor the inner tank for leaks.

In some dual containment tanks, the space between the inner and outer tanks is filled with one or more materials offering additional insulating and/or structural support to the tank. These tanks are commonly known as storage vaults and concrete is often on of the interdisposed materials. The present invention is a variant of this type of storage vaults.

One of the primary objects of this invention is to provide an above ground storage vault with a dual containment construction in which a space between the two tanks can be monitored for leaks. The present invention also provides a storage vault in which the space between the inner and outer tanks is at least partially filled with a material that serves both an insulating and structural function.

To achieving these and other objects, the present invention provides an above ground liquid storage vault having a composite construction. The vault is generally constructed of an inner tank and an outer tank. The inner tank defines a primary containment cavity which is adapted to receive and store a liquid, such as gasoline. The inner tank includes an inlet fitting, a discharge fitting and a vent, all of which extend to positions exterior of the vault. Additional fittings, if desired, can be provided on the vault as determined by the particular application to which the vault will be applied.

Before being positioned within the outer tank, the inner tank is first encapsulated in a layer of an insulating material. In addition to insulating the liquid in the inner tank, the first layer is made of a material which will at least partially dissolve, melt or otherwise liquify upon contact with any leaked liquid from the inner tank.

A monitor tube is positioned immediately exterior of this first layer and extends from a leak collection region, located near the bottom of the inner tank, to a position exterior of the outer tank. If a leak does occurs in the inner tank, a portion of the first layer near the leak will dissolve and the leaked liquid will be allowed to naturally progress to the leak collection area where it will be detected by manual or automated monitoring through the monitor tube.

After the inner tank has been encapsulated within the insulating material, both the inner tank and the insulating material, as well as the monitor tube, are further encapsulated by a membrane. Unlike the insulating layer, the membrane is impervious to the specific liquid being stored and does not react or dissolve when it comes into contact with leaked liquid. The membrane therefore provides a barrier to further leakage from the vault.

The encapsulated inner tank, as so far described, is then positioned within the cavity of the outer tank. In positioning the encapsulated inner tank within the outer tank, the encapsulated inner tank is supported on spacers in the outer tank which provide a space or gap between the interior surfaces of the outer tank and the exterior surfaces of the encapsulated inner tank. This space is filled with a structural and insulating material which further covers the bottom, sides and top of the inner tank. In one preferred embodiment of this invention, the structural and insulating material is concrete.

Hold-down members extend between the side walls of the outer tank across the top of the encapsulated inner tank so as to prevent the inner tank from floating on the poured concrete. The top wall of the outer tank is secured to the side walls of the outer tank by welding or some other securement method and is provided with an opening through which the concrete may be poured once the vault has been delivered to its site o usage.

Since the composite vault is to be used above ground and, most likely outdoors, the exterior surface of the outer tank is coated with an anti-corrosion material which protects the outer tank and enhances the aesthetic appearance of the vault. Reinforced fiberglass is one material which meets the criteria for the anti-corrosion material.

The vault is also provided with bottom supports or risers which raise the vault several inches above the surface on which it is supported. These risers allow the surface beneath the vault to be visually inspected for further evidence of leakage and also enable the vault to be anchored to the support surface.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENT

Figure 1:
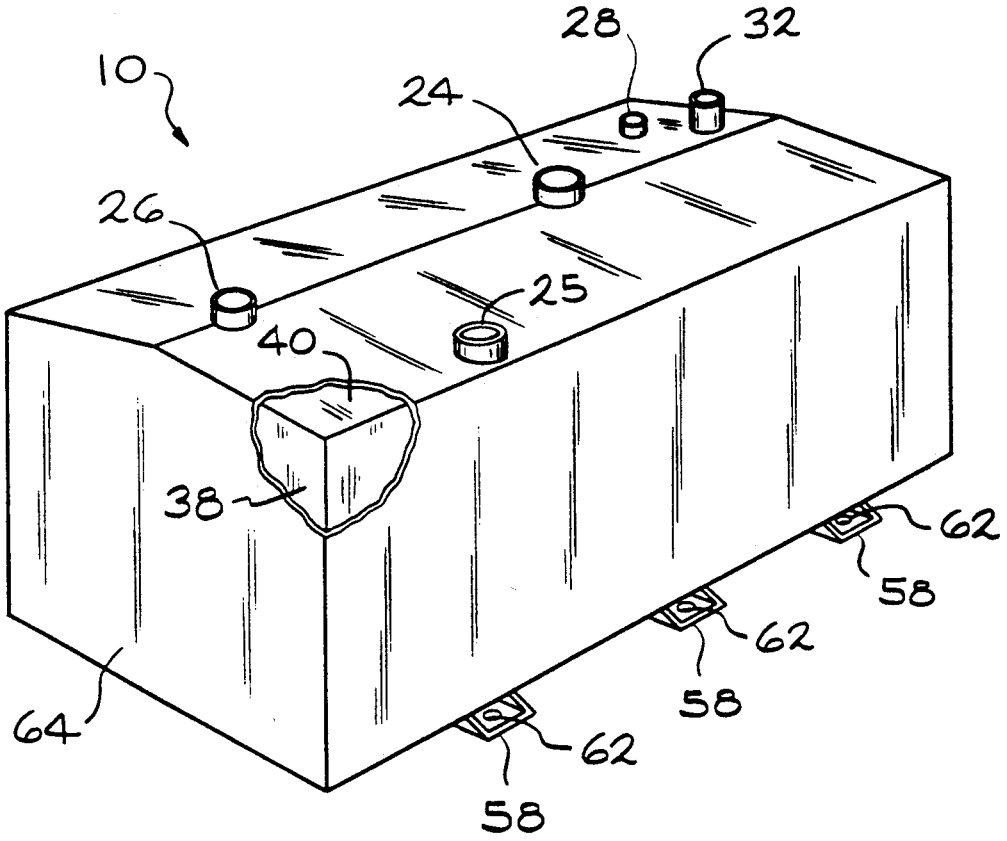
FIG. 1 is a perspective view of a composite above ground liquid storage vault, with portions broken away, embodying the principles of the present invention.
Figure 2:
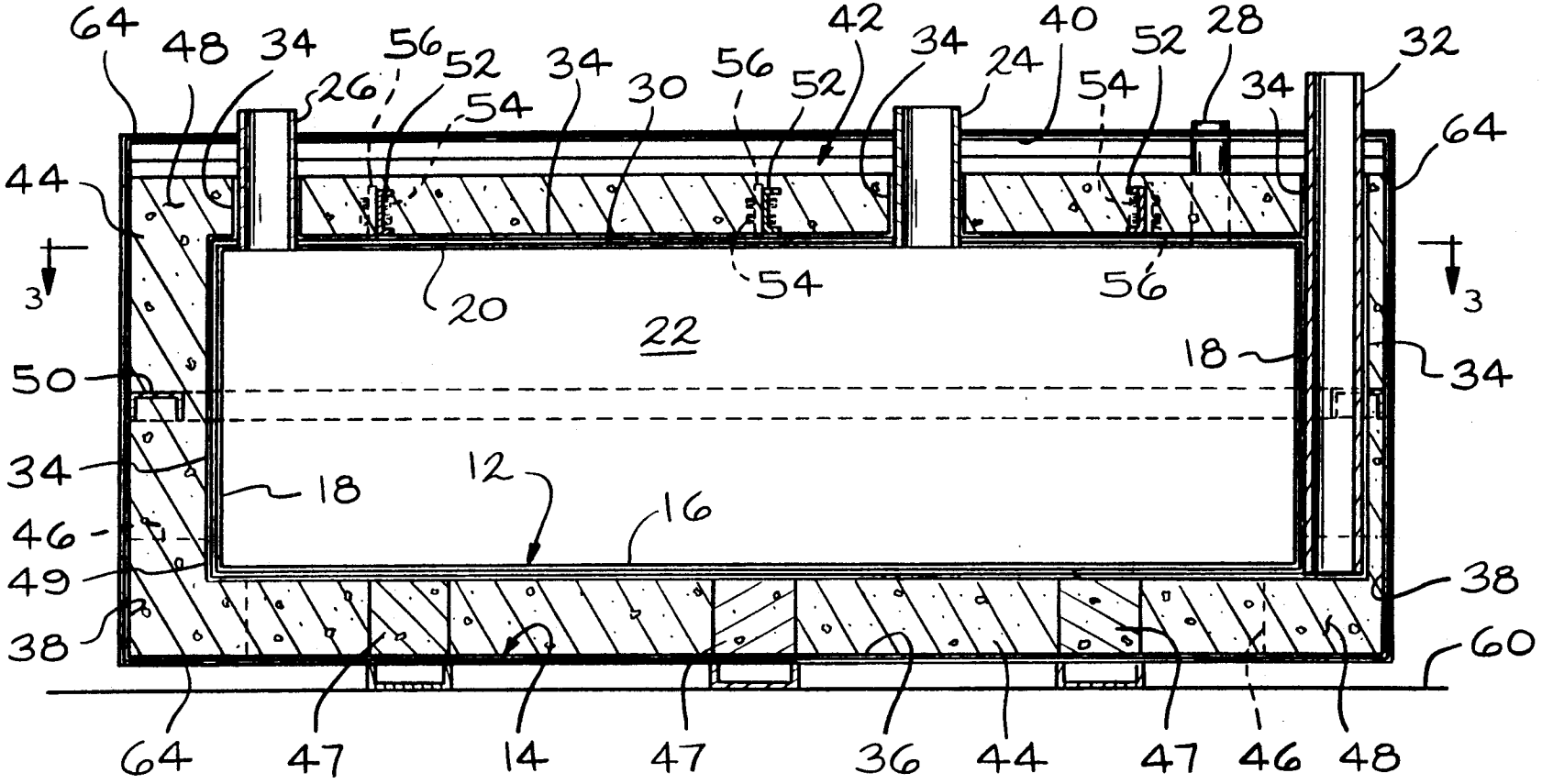
FIG. 2 is a side elevational view taken substantially along line 2—2 in FIG. 3 of the liquid storage vault.
Figure 3:
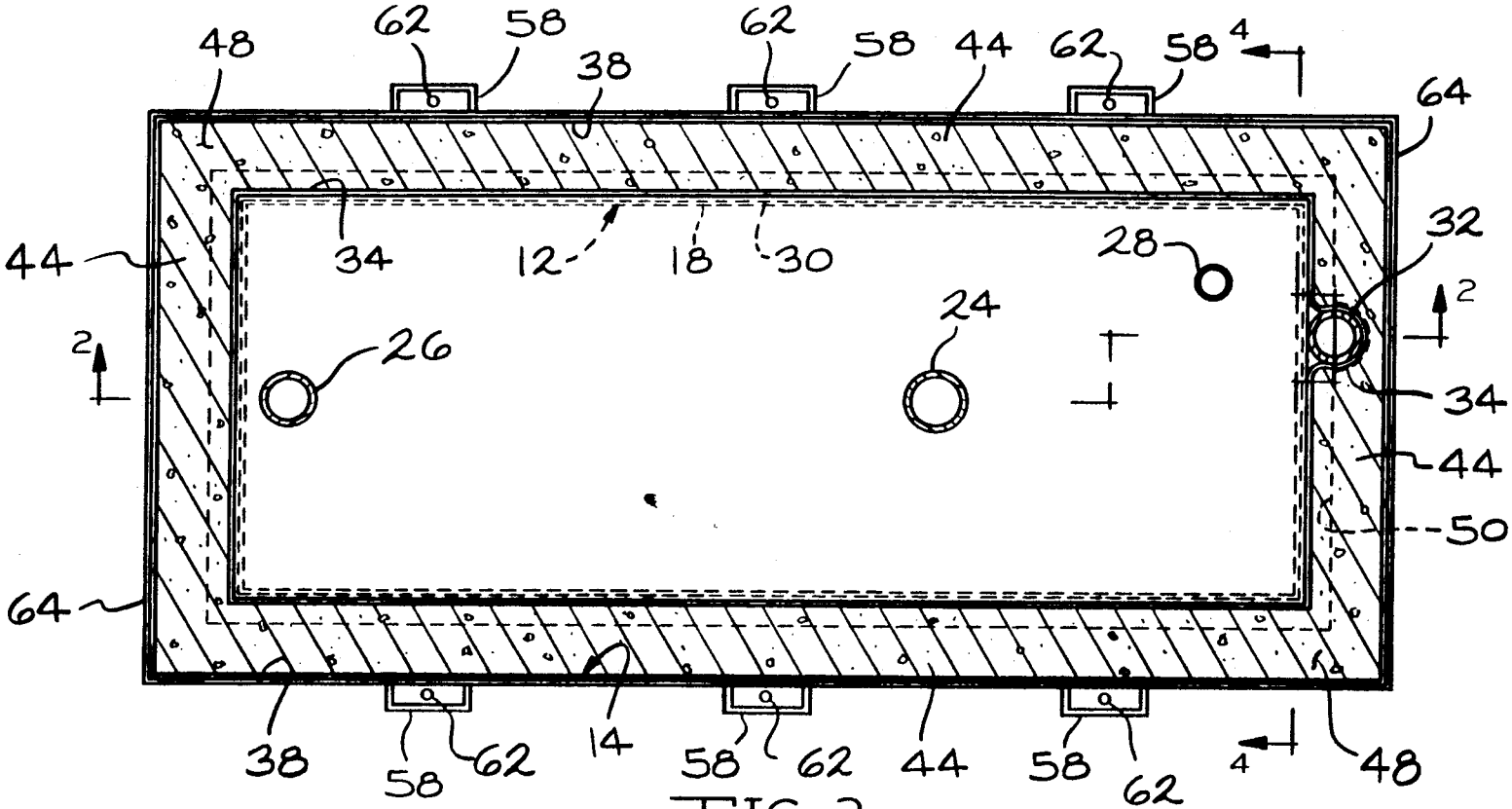
FIG. 3 is a sectional view taken substantially along line 3—3 in FIG. 2 of a vault embodying the principles of the present invention.
Figure 4:
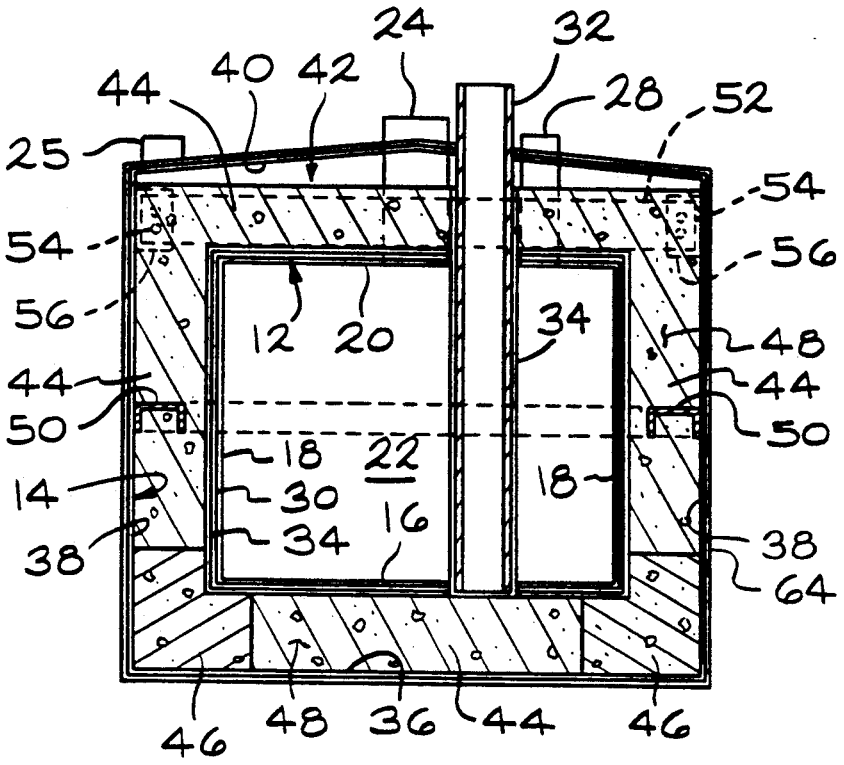
FIG. 4 is a sectional view of the vault illustrated in FIG. 3 taken substantially along line 4—4.
Figure 5:
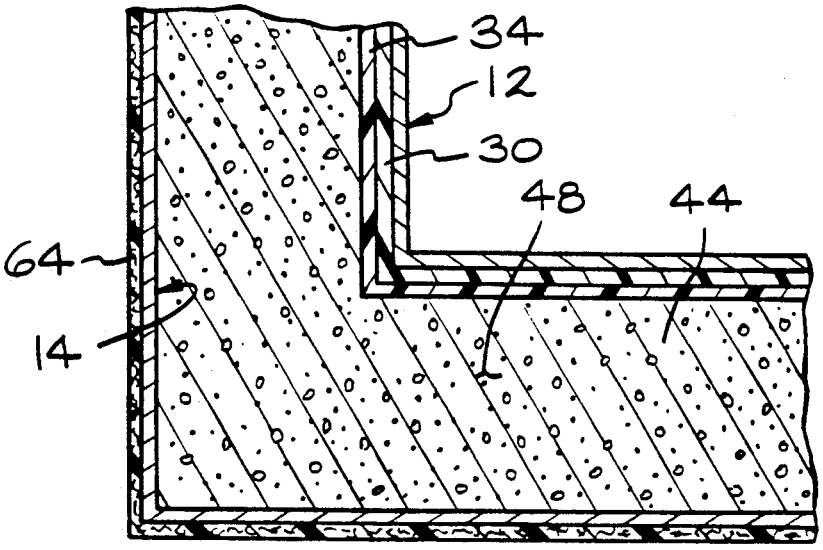
FIG. 5 is a sectional view of a portion of the vault seen in FIG. 1 showing the various encapsulating layers which make up the composite construction of the vault.

Referring now to the drawing, an above ground composite liquid storage vault embodying the principles of the present invention is illustrated in FIG. 1 and generally designated at 10. Two of the primary features of the vault 10 are an inner tank 12 and an outer tank 14 with the inner tank 12 being positioned within the outer tank 14. The vault 10, therefore has a dual containment construction which, along with various other features of the vault 10, enable it to be used for the above ground storage of a variety of liquids, including volatile liquids such as gasoline.

The outer tank 14 is the secondary containment vessel of the vault 10 and includes a bottom wall 36, side walls 38 and a top wall 40 which cooperate to define a receiving cavity 42 for the inner tank 12 and its related structures. For the reasons which are more fully discussed below, the top wall 40 is provided with an opening or fitting 25.

The primary containment vessel of the vault 10 is the inner tank 12. The inner tank 12 generally which includes a bottom wall 16, substantially upright side walls 18 and a top wall 20, all of which cooperate to define a containment cavity 22 into which the liquid is disposed. To enable easy filling and discharge of the liquid into and out of the vault 10, the inner tank 12 is also provided with an inlet fitting 24 and an outlet fitting 26. The fittings 24 and 26 extend upward from the top wall 20 of the inner tank 12, through the top wall 40 of the outer tank 14, and terminate a location outside of the outer tank 14. While not shown in the figures, the fittings 24 and 26 are also provided with closure caps that seal the fitting 24 and 26 and prevent the introduction of foreign objects and other contaminants into the liquid.

As illustrated, the inner tank 12 is substantially rectangular in shape and constructed of a metal which is not reactive with the particular liquid being stored. Because of its strength and non-reactance with numerous liquids, one preferred metal is carbon steel with a thickness of about 10 gage. Understandably, alternative shapes and configurations for the inner tank 12, such as a cylindrical configuration, could be used without deviating from the principles and scope of this invention. Alternative configurations are, therefore, deemed to be within the purview of this invention.

The inner tank 12 also includes a vent 28 which extends from the top wall 20 of the inner tank 12, in a manner similar to the fittings 24 and 26. The vent 28 allows air within the tank 12 to escape during the filling process and also compensates for pressure and temperature changes within the liquid and the vault 10 by permitting the built-up vapor pressure to be safely released from the vault 10. Employing a construction well known within the industry, the structural details of the vent are not specifically set out herein.

Before being positioned within the outer tank 14, the exterior surfaces of the inner tank 12 are covered with several layers of materials which perform different functions. The first layer surrounding the inner tank 12 is a layer 30 of insulating material. This insulating layer 30 covers all the exterior surfaces of the inner tank 12 including the bottom wall 16, the side walls 18 and the top wall 20. In addition to the additional layers discussed below, the insulating layer 30 limits the effects of external temperature changes on the liquid stored in the vault 10. For reasons also described in greater detail below, the first layer 30 is preferably a material which will dissolve, melt or otherwise liquify upon contact with liquid leaking through the inner tank 12. In the case of gasoline, one preferred material is polystyrene having a thickness of about ¼ inch.

Positioned at one end of the inner tank 12, immediately exterior of the first layer 30, is a monitor tube 32. The monitor tube 32 extends upward along the first layer 30 and the side wall 18 of the inner tank 12 and has its lower end positioned adjacent to the inner tank's bottom wall 16. The upper end of the monitor tube 32 terminates at a position outside of and above the outer tank 14.

The monitor tube 32 and the inner tank 12, covered with the first layer 30, are further encapsulated by a liquid impermeable membrane or second layer 34, such as 20–30 mil. polyethylene. The membrane layer 34 is also provided so that it will encapsulate those portions of the fittings 24 and 26 and the vent 28 where they extend up from the inner tank 12 before exiting the outer tank 14.

The inner tank 12, encapsulated as described above, is enclosed within the outer tank 14 which has a shape generally corresponding to that of the inner tank 12 (rectangular). As such, the outer tank 14 similarly has a welded construction and includes a bottom wall 36, upright side walls 38 and a top wall 40 that cooperate to define a receiving cavity 42 for the inner tank 12 and its various encapsulating layers. Preferably, the walls 36, 38 and 40 of the outer tank 14 are also constructed of 10 gauge carbon steel and provide the vault 10 with a sufficient amount of strength and corrosion resistance.

When the encapsulated inner tank 12 is positioned within the outer tank 14, a space (designated at 44) is defined between the membrane layer 34 and the interior surfaces of the outer tank 14. This space 44 is produced by positioning concrete spacers 46 in the four bottom corners of the outer tank 14 and then lowering the encapsulated inner tank 12 into the outer tank 14 and onto the spacers 46. While the spacers 46 can be constructed from alternative materials and located in different positions within the outer tank 14, in the illustrated embodiment, four concrete spacers 46 are provided to support the four corners of the encapsulated inner tank 12. The spacers 46 are blocks having their inner and upper corners configured with a recess 49 which will receive a lower corner of the encapsulated inner tank 12. The recesses 49 ensure that the encapsulated inner tank 12 is properly and evenly located with respect to the various walls 36, 38 and 40 of the outer tank 14.

In addition to the spacers 46 in the four corners of the outer tank 14, three transverse spacers 47 are positioned generally equidistantly along length of the encapsulated inner tank 12 so as to extend transversely beneath the width of the bottom wall 16 thereby further supporting the encapsulated inner tank 12. The transverse spacers 47 are also formed from concrete.

Once the inner tank 12 has been positioned within the outer tank 14, the top wall 40 of the outer tank 14 is welded to the side walls 38 enclosing the inner tank 12. The space 44 between the two tanks 12 and 14 is then filled, through the fitting 25 in the top wall 40, with a material 48 that will both strengthen and insulate the vault 10. Two types of materials specifically contemplated by the present invention are concrete and refractory material. Because of the weight of wet concrete 48, it is possible that the side walls 38 of the outer tank 14 will bow outwardly when the concrete 48 is poured. This bowing is prevented by utilizing a reinforcement beam or member 50 positioned generally horizontally along each side wall 38 of the outer tank 14 at approximately its mid-height. In the illustrated embodiment, the reinforcement members 50 are shown as lengths of channel iron welded to the interior surfaces of the side walls 38. Of course, the reinforcement members 50 could be provided in other forms including, but not limited to angle iron. If the channel iron making up the reinforcement member 50 is positioned with its cupped portion facing downward, openings should be provided in the reinforcement member 50 to allow trapped air to escape during pouring of the concrete.

It is also possible that, as a result of the weight of the wet concrete 48, the inner tank 14 will float on the concrete 48 resulting in the inner tank 12 not being completely encased after the concrete 48 has dried. To prevent the inner tank 14 from floating, a series of hold down members 52 are provided so as to extend between the side walls 38 of the outer tank 14 across the top of the encapsulated inner tank 12.

In the preferred embodiment, the hold down members 52 extend transversely between the longitudinal side walls 38 of the outer tank 14 and generally across the top wall 20 of the inner tank 12 at a height which will be below the top of the poured concrete. By extending across the top wall 20 of the inner tank 12, the hold down members 52 allow the concrete to be poured over the top wall 20 of the inner tank 12 and prevent the inner tank 12 from floating on the wet concrete 48. The result is that the encapsulated inner tank 12 is completely immersed in the dried concrete 48.

The hold down members 52 are installed after the encapsulated inner tank 12 has been positioned on the spacers 46 and 47 within the outer tank 14. Once the encapsulated inner tank 12 is in place, the hold down members 52 are bolted by fasteners 54 to mounting brackets 56 which are welded or otherwise secured to the side walls 38 of the outer tank 14 and the top wall 40 is welded to the side walls 38.

In addition to the fitting 25 through which the concrete is poured, the top wall 40 is also provided with apertures (not designated) which allow the inlet fitting 24, the discharge fitting 26, the vent 28 and the monitor tube 32 to extend through the top wall 40, with the apertures then being sealed therearound, for easy access by a user of the vault 10.

After the concrete has set, the inner tank 12 can then be filled with the liquid through the inlet fitting 24 by a gauge pump or other filling means. During the filling process, air displaced from within the inner tank 12 will escape through either the inlet fitting 24 or the vent 28.

After filling, if the inner tank 12 acquires a leak, the leaked liquid will pass through the inner tank 12 and come into contact with the insulation layer 30, which dissolves or melts, and is then contained by the membrane 34. The membrane 34 causes the leaked liquid to progress toward and collected in an area adjacent to the lower end of the monitor tube 32. Depending on the desired sophistication of the vault 10, any of the variously known monitoring techniques can be used in conjunction with the monitor tube 32 to detect the presence of the leaked liquid. For example, the monitor tube 32 could be used to provide visual access o determine whether or not leaked liquid has collected within the tube 32. Alternatively, a sensor, coupled to a controller (not shown), could be placed in the lowermost portion of the monitor tube 32 so as to activate the necessary alarms if a leak is detected.

The concrete 48, provided between the inner and outer tanks 12 and 14, serves a dual purpose. First, the concrete 48 physically protects the inner tank 12 from being ruptured or punctured as a result of the vault being impacted by an object. Such an impact might be the result of a natural disaster or a motor vehicle inadvertently running into the vault 10.

The second purpose of the concrete 48 is to provide additional insulation around the inner tank 12 making the liquid within the inner tank 12 less susceptible to the temperature fluctuations experienced outside of the vault 10. By limiting the effects of temperature variations on the liquid within the vault 10, moisture problems and pressure build ups can be prevented or eliminated. The insulative effects of the structural material 48 also allows this material 48 to operate as a fire wall which enables the vault 10 to safely store flammable and volatile liquids. In the preferred embodiment, six inches of concrete are provided between the inner and outer tanks 12 and 14 resulting in the vault 10 having approximately a two hour firewall rating.

While concrete 48 is disclose as the preferred structural material 48, alternate materials could be used in its place. One such class of materials are refractory materials. In addition to insulating and structurally protecting the inner tank 12, the refractory material enhances the vault 10 by substantially reducing its overall weight.

The vault 10 is also provided with a series of risers 58 which operate to elevate the bottom wall 36 of the outer tank 1 above the surface, designated at 60, supporting the vault 10. By elevating the vault 10, the support surface 60 can be visually inspected for leaks occurring through all of the various layers of the vault 10, including the concrete 48 and the outer tank 14. The risers 58 are additionally provided with apertures 62 that enable the vault 10 to be anchored to the support surface 60 by fasteners (not shown) such as common masonry fasteners.

Since the vault 10 is intended to be located above ground, the exterior surfaces of the outer tank 14 is coated with a corrosion resistant material 64 such as reinforced fiberglass. When stored outdoors, the fiberglass 64 prevents the exterior surfaces of the outer tank 14 from rusting or being otherwise damaged through exposure to the elements. The fiberglass also enhances the aesthetics of the vault.

While the above description constitutes the preferred embodiment of the present invention, it will be appreciated that the invention is susceptible to modification, variation and change without departing from the proper scope and fair meaning of the accompanying claims.

I claim:

1. A composite above ground liquid storage vault comprising:

an inner tank having exterior surfaces defined by a bottom wall, side walls and a top wall cooperating to define a primary containment cavity, said cavity adapted to receive and store liquids therein, said inner tank also including at least one fitting, said fitting enabling the liquid to be disposed into or discharged from said inner tank of said vault;

a first layer covering said exterior surfaces and substantially encapsulating said inner tank, said first layer being formed of an insulative material and said fitting extending from said inner tank and through said first layer;

an upright monitor tube exteriorly positioned relative to said first material and said inner tank, said monitor tube having a pair of ends, one of said ends being located generally adjacent to said bottom wall and the other of said ends being located generally above said top wall of said inner tank;

a second layer exteriorly covering said monitor tube, said first layer and said inner tank thereby forming an encapsulated inner tank, said second layer being formed of a liquid impervious material and forming a liquid impervious barrier completely around said monitor tube, said first layer and said inner tank;

an outer tank having a bottom wall, side walls and a top wall cooperating to define a receiving cavity adapted to receive said encapsulated inner tank, said fitting extending from said inner tank through said outer tank and terminating at a location exterior of said outer tank;

spacer means located within said outer tank for supporting said encapsulated inner tank in spaced apart relation from interior surfaces of said outer tank; and a third layer disposed within and filling said space between said outer tank and said encapsulated inner tank so as to substantially completely encase said encapsulated inner tank therein, said third layer being a structural material protecting said inner tank from rupture, further insulating said inner tank and providing said vault with a firewall.

2. A composite liquid storage vault as set forth in claim 1 wherein said second layer substantially encapsulates said fitting within said outer tank.

3. A composite liquid storage vault as set forth in claim 1 wherein said spacer means includes a plurality of spacers supported within said outer tank on said bottom wall thereof, said spacers contacting and supporting said encapsulated inner tank.

4. A composite liquid storage vault as set forth in claim 3 wherein said plurality of spacers include locating means for equidistantly locating said encapsulated inner tank from said interior surfaces of said outer tank.

5. A composite liquid storage vault as set forth in claim 4 wherein said locating means includes recesses defined in said spacers for receiving a portion of said encapsulated inner tank therein.

6. A composite liquid storage vault as set forth in claim 3 wherein said outer tank is generally rectangular and has four spacers generally positioned within four lower corners of said outer tank, said encapsulated inner tank also being rectangular and being supported by said spacers at corners thereof.

7. A composite liquid storage vault as set forth in claim 3 wherein said spacers include at least one spacer extending transversely between side walls of said outer tank and across the bottom of said encapsulated inner tank and supporting said encapsulated inner tank from thereunder.

8. A composite liquid storage vault as set forth in claim 3 wherein said spacers are concrete.

9. A composite liquid storage vault as set forth in claim 1 wherein said inner tank is steel and wherein said outer tank is steel.

10. A composite liquid storage vault as set forth in claim 1 wherein said first layer is a material which dissolves upon contact with the liquid in said vault.

11. A composite liquid storage vault as set forth in claim 10 wherein said first layer is polystyrene.

12. A composite liquid storage vault as set forth in claim 1 wherein said second layer is polyethylene.

13. A composite liquid storage vault as set forth in claim 1 wherein said third layer is concrete.

14. A composite liquid storage vault as set forth in claim 1 wherein said third layer is a refractory material.

15. A composite liquid storage vault as set forth in claim 1 wherein said outer tank is coated with a corrosion resistant material.

16. A composite liquid storage vault as set forth in claim 15 wherein said corrosion resistant material is fiberglass.

17. A composite liquid storage vault as set forth in claim 1 wherein top wall of said outer tank is provided with an aperture through which said third layer is a material capable of being poured into said space and over said encapsulated inner tank.

18. A composite liquid storage vault as set forth in claim 1 further comprising holddown means for maintaining said encapsulated inner tank within said third layer and preventing said encapsulated inner tank from floating therein.

19. A composite liquid storage vault as set forth in claim 18 wherein said holddown means includes holddown members extending transversely between said side walls of said outer tank and over said encapsulated inner tank.

20. A composite liquid storage vault as set forth in claim 19 wherein said holddown members are secured to said side walls of said outer tank.

* * * * *